US006269792B1

(12) United States Patent
Hakansson

(10) Patent No.: US 6,269,792 B1
(45) Date of Patent: Aug. 7, 2001

(54) INTERNAL COMBUSTION ENGINE WITH COMPRESSOR FUNCTION

(75) Inventor: Nils Olof Hakansson, Stenkullen (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 09/486,475

(22) PCT Filed: Aug. 26, 1998

(86) PCT No.: PCT/SE98/01528

§ 371 Date: Mar. 28, 2000

§ 102(e) Date: Mar. 28, 2000

(87) PCT Pub. No.: WO99/10631

PCT Pub. Date: Mar. 4, 1999

(30) Foreign Application Priority Data

Aug. 26, 1997 (SE) ..... 9703066

(51) Int. Cl.[7] ..... F02D 13/04
(52) U.S. Cl. ..... 123/322
(58) Field of Search ..... 123/321, 322, 123/198 D, 320

(56) References Cited

U.S. PATENT DOCUMENTS 4,742,806 * 5/1988 Tart, Jr. et al. ..... 123/322
5,379,737 * 1/1995 Hu ..... 123/322
5,636,611 * 6/1997 Frankle et al. ..... 123/322
5,735,242 * 4/1998 Kahlenbeck et al. ..... 123/322

FOREIGN PATENT DOCUMENTS 0 608 522 8/1994 (EP) .
0 640 751 3/1995 (EP) .
WO 92/09792 6/1992 (WO) .
WO 96/10125 4/1996 (WO) .

* cited by examiner

*Primary Examiner*—Thomas N. Moulis
(74) *Attorney, Agent, or Firm*—Young & Thompson

(57) ABSTRACT

The engine includes in at least one engine cylinder, an extra exhaust valve operated by a hydraulic plunger cylinder device. The engine has a fuel system with a unit injector, the cam and rocker arm of which also drive a pump arrangement, which has a pump chamber communicating with the low pressure side of the fuel system. The plunger of the plunger cylinder device is loaded by the pressure in the pump chamber. When a valve disposed in the communication between the fuel system and the pump chamber is closed, the fuel volume enclosed during the pump stroke will displace the plunger, opening the exhaust valve.

12 Claims, 3 Drawing Sheets

INTERNAL COMBUSTION ENGINE WITH COMPRESSOR FUNCTION

FIELD OF THE INVENTION

The present invention relates to an internal combustion engine with compressor function, comprising inlet and exhaust valves for each cylinder, a fuel injection system with a unit injector and an electrically operated spill valve for each cylinder, an extra exhaust valve at at least one cylinder, said valve being a disc valve with a valve disc and a spindle disposed in a bore and cooperating with spring means, which bias the disc valve towards a closed position, and a hydraulic plunger cylinder device, by means of which the disc valve can be opened.

BACKGROUND OF THE INVENTION

It is previously known to use one or more cylinders in diesel engines as compressor cylinders by providing each of the cylinders with an extra exhaust valve and equipping the engine injection system with devices through which the fuel supply can be cut off to the engine cylinders functioning as compressor cylinders. Such a compressor arrangement can i.a. be designed to supplement the ordinary engine unit air compressor, which normally supplies the vehicle compressed air system when its capacity is not sufficient for some reason, or it can function as the sole compressed air source for the vehicle.

SE 9003735-9 describes an internal combustion engine of the type described by way of introduction. The extra east valve is hydraulically operated with the air of a hydraulic pump with control valves. When the engine cylinder with the extra exhaust valve is to work as a compressor, the valve is set in the open position and the fuel supply via the associated unit injector is cut off by holding its spill valve open. The exhaust valve is kept constantly open as long as the compressor function is to be maintained, and re-entry of air via the extra exhaust valve is prevented during the intake stroke by means of a non-return valve disposed in the exhaust channel.

An arrangement of this type functions satisfactorily when the engine is to work as a compressor at low load, for example, during engine braking when driving downhill. If an extra air supplement is required even when the engine is loaded, several problems will arise, however. The vibrations arising when an engine cylinder is completely decoupled, can be so great that the vehicle gearbox in particular will be subjected to unacceptable wear, which reduces its useful life to less than half of the normal useful life. If the engine is turbocharged, there is lost not only a sixth of the normal power (in a six-cylinder engine with one cylinder decoupled) but as much as half of the power can be lost due to the loss of charge air pressure which occurs when the gas flow to the turbine of the turbocompressor is reduced An additional problem is that the high air pressure in the cylinder in combination with the constriction of the non-return valve generates very high temperatures in the non-return valve, placing heavy requirements on its design to make its function and useful life acceptable.

SUMMARY OF THE INVENTION

The purpose of the present invention is in general to provide an internal combustion engine of the type described by way of introduction, in which the compressor function can be utilized even when the engine is loaded, without problems arising with vibrations and heavy power losses.

This is achieved according to the invention by virtue of the fact that the plunger of the plunger cylinder device is subjected to the pressure in a pump chamber which communicates with the fuel injection system and which belongs to pump means which are driven by a cam element having a cam curve, which initiates a pump stroke in said pump means before cam means driving pump means in the unit injector initiate a pump stroke, and that the valve means comprise a control valve which, in its closed position, blocks the communication of the pump chamber of the first mentioned pump means with the fuel injection system, so that the fuel volume enclosed during the pump stroke produces a displacement of the plunger of the plunger cylinder device with associated displacement of the disc valve towards it open position.

By using the fuel, instead of the engine oil as a hydraulic medium and controlling the fuel in the same manner as the injection system, a very rapid engagement and disengagement of the compressor function can be achieved Thus, the control valve can be an electrically operated spill valve of the same type as the unit injector spill valve and can also be controlled by the same control unit that controls the fuel injection. The rapid engagement and disengagement of the compressor function, i.e. the opening and closing of the extra exhaust valve, can be determined however desired by the software in the engine-controlled computer m the same manner as the fuel injection is determined. This rapidity means that the compressor function does not need to be engaged during each cycle during power extraction from the engine; only at certain intervals, e.g. each fifth cycle. This in turn reduces engine vibrations and allows the charge pressure to be kept high, thus also power losses. If, for example, one engine cylinder in a six-cylinder engine works as a compressor each fifth cycle, the loss will be 20 % of slightly more than 16%, or ca 3,5%. This loss can be easily compensated for with a somewhat increased amount of fuel. Finally, the rapid control (within milliseconds) of the extra exhaust valve provides complete force control/time control of the valve, so that the non-return valve and the problems associated therewith can be eliminated.

BRIEF DESCRIPTION OF THE DRAWINGS

The invention will be described in more detail below with reference to examples shown in the accompanying drawings, where.

DETAILED DESCRIPTION OF THE PREFERRED EMBODIMENT

Figure 1:
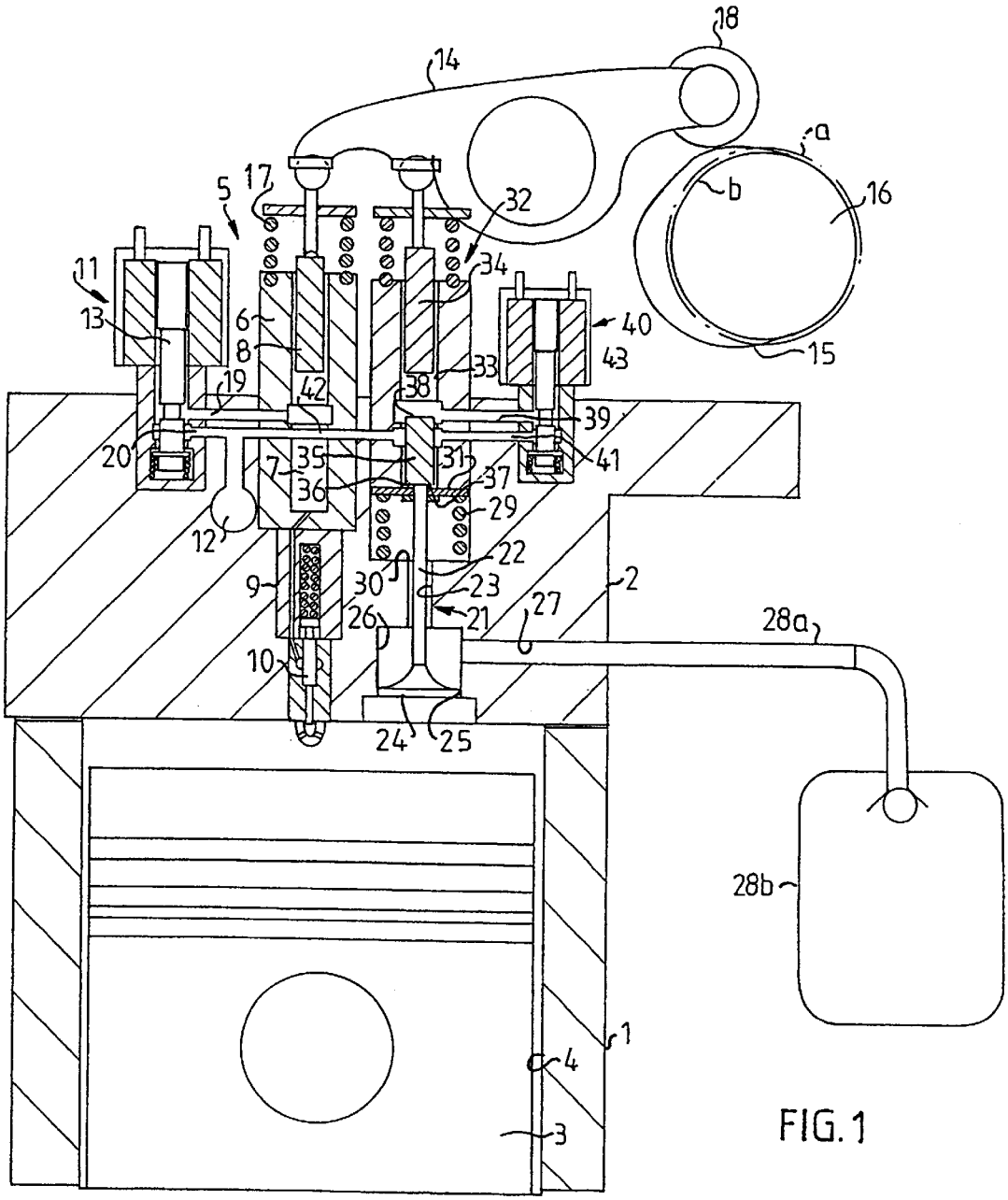
FIG. 1 shows schematically a cross-section through a first embodiment of a portion of an engine according to the invention.

1 in FIG. 1 designates a portion of a cylinder block, and 2 indicates a cylinder head. Parts such as intake and exhaust ducts with associated valves and other components which are not directly related to the invention, have been eliminated for the sake of simplicity. The engine is a direct injection diesel and has a piston 3 in a cylinder 4. It has an injection system with a so-called unit injector 5 of a type known per se and comprises a pump portion 6 with a pump plunger 8 in a pump chamber 7 and an injector portion 9 with a valve needle 10 controlled by the fuel pressure. The pump chamber 7 communicates via a spill valve 11 with a fuel channel 12 on the low-pressure side of the fuel system, to which fuel is fed by a feeder pump (not shown).

The spill valve 11 has a valve element 13 operated by an electromagnet and it is controlled in a manner known per se by the engine control computer (not shown). With the aid of the spill valve 11 the injection time and fuel amount are determined. The pump stroke of the injection pump plunger 8 is achieved with the aid of a rocker arm 14 and a cam element 15, cooperating therewith, on a cam shaft 16. A return spring 17 returns the pump plunger 8 to a starting position when the cam follower 18 on the rocker arm 14 reaches the base circle of the cam element (see FIG. 3). In the position shown in FIG. 1, the spill valve 11 is closed, which means that a channel 19 from the pump chamber 7 is shut off from a channel 20 to the low-pressure side of the fuel system. When a certain pressure (ca 300 bar) has been reached during the stroke of the pump 8, the fuel needle 10 opens the fuel nozzle and the injection begins and is maintained until the spill valve 11 opens, connecting the channel 19 to the channel 20 to the low-pressure side 12, and the injection will be stopped even if the pump stroke has not been completed.

The cylinder shown has an extra exhaust valve 21 in addition to the exhaust valve which is not shown. The valve 21 has a spindle 22 in a bore 23, and a valve disc 24 which rests against a seat 25 in a broader portion 26 of the bore 23. From the broader portion 26 a channel 27 exits the cylinder head into a conduit 28*a* which opens into a pressure tank 28*b*.

The valve disc 24 is pressed against its seat 25 by a helical spring 29, which is tensioned between a shoulder 30 in the cylinder head 2 and a plate 31 solidly joined to the spindle 22.

A pump device 32 corresponding to the pump portion 6 of the injector 5 is arranged in the cylinder head 2 to one side of the injector 5. The pump device 32 has a pump plunger 34 disposed in a pump chamber 33. The piston movement is achieved with the same rocker aim 14 and cam element 15 as operate the plunger 8 in the injector 5. An operating plunger 35 in a cylinder chamber 36 has an end 37 abutting against the end of the valve spindle 22 and its opposite end 38 protruding into the pump chamber 33, which can be connected via a channel 39, a control valve 40 and channels 41 and 42, to the low-pressure side 12 of the fuel system The valve 40 is of the same type as the spill valve 11 and thus has a valve element 43 which is electromagnetically operated, preferably by the control computer (not shown) of the engine, as is the spill valve 11. In the position shown in FIG. 1 of the valve element 43, the valve is closed and the pump chamber 33 is thus cut off from the low-pressure side 12 of the fuel system, where the pressure is normally about 4 bar. The force of the return spring 29 is thus adapted so that it keeps the exhaust valve 21 closed when there is this pressure in the pump chamber. When the valve 40 is closed, there will be an increasing pressure in the pump chamber 33 during the stroke of the pump plunger 34, thus creating a force against the operating plunger 35, which overcomes the force of the return spring 29 so that the exhaust valve 21 opens.

Figure 3:
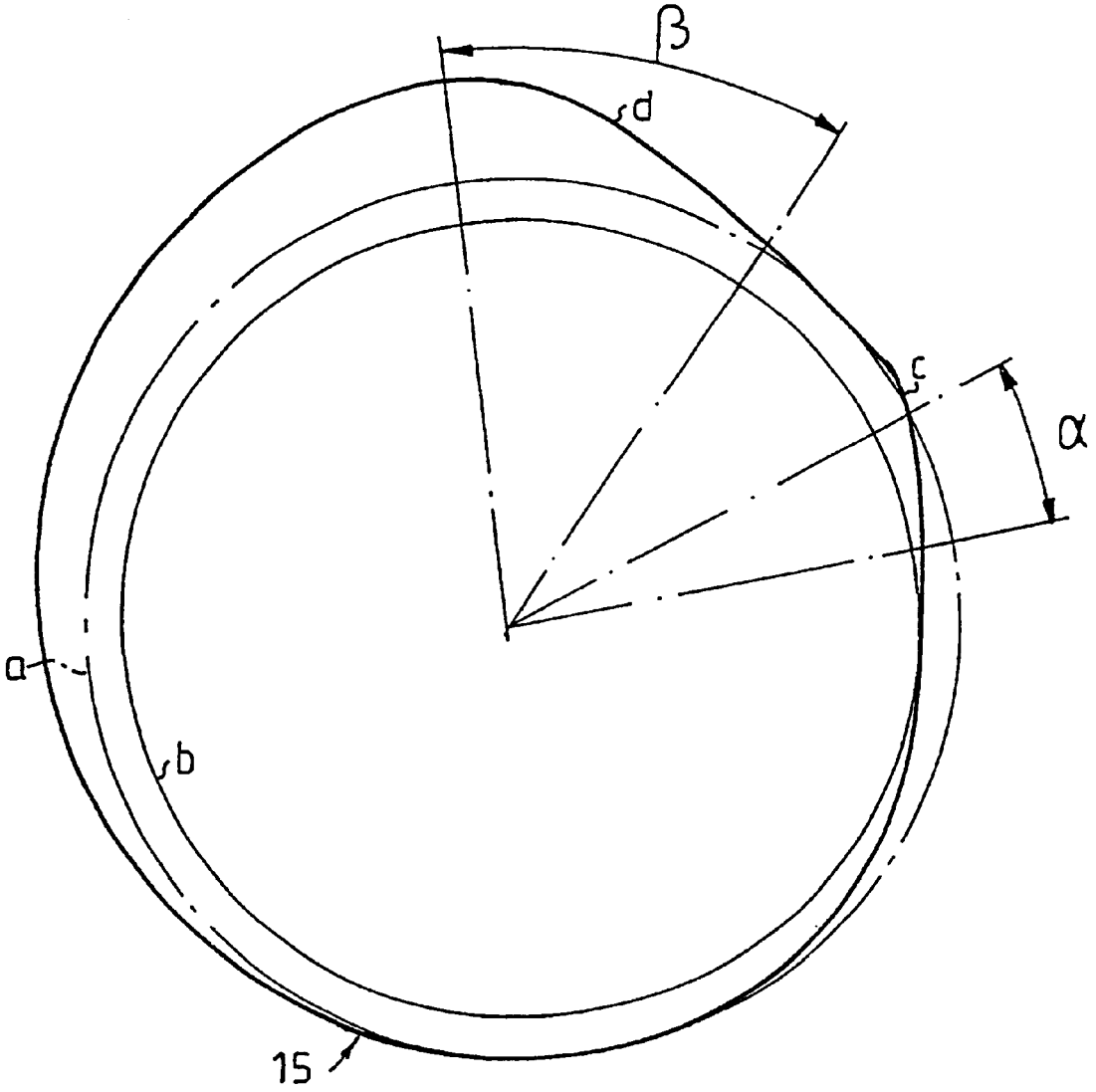
FIG. 3 shows a cam profile of a cam element cooperating with the unit injector.

The pump movements of both the unit injector 5 and the pump device 32 are achieved with the aid of the cam element 15, the cam profile of which is shown most clearly in FIG. 3. By merely grinding down the basic circle "a" of an "ordinary" cam in a fuel injection system with unit injectors, a smaller base circle "b" is obtained, which makes it possible to form an extra cam curve "c" for the stroke of the pump plunger 34 of the exhaust valve 21, in front of the ordinary cam curve "d" for the stroke of the pump plunger 8 of the unit injector 5. The cam curve and are so arranged in relation to each other that the extra exhaust valve is opened after the initial portion of the piston compression stroke. In FIG. 3, $\alpha$ designates the cam angle for the stroke of the exhaust valve 21 and $\beta$ designates the cam angle for the stroke of the injector 5. During engine operation, the plungers 8 and 34, respectively, of the unit injector and the exhaust valve, respectively, will perform one stroke per work cycle. The opening and closing of the exhaust valve 21 is only regulated with the aid of the valve 40, which is controlled by the engine control unit. Thus, the exhaust valve 21 can be controlled as rapidly as the fuel injection, i.e. within milliseconds. In a practical embodiment, the stroke for opening the exhaust valve can be ca 4 mm, which is to be compared with the fuel injection pump stroke of ca 17 mm. The rapid control of the exhaust valve makes it possible, depending on the operating conditions (fight load or heavy load), with the aid of the engine control unit, to open and close the exhaust valve during each work cycle or at a chosen interval e.g. each fifth work cycle. It is possible, at least theoretically, to only use an initial portion of the compression stroke for air pumping and then ignite the remaining air after the final portion of the compression stroke and thus reduce the engine power loss further if this should be required.

In the embodiment described above, the control of the exhaust valve 21 is, in principle, independent of the setting of the unit injector spill valve 11 even though it is, of course, in practice so that if the entire compression stroke is to be used for air pumping, the spill valve 11 must be open to prevent fuel injection.

Figure 2:
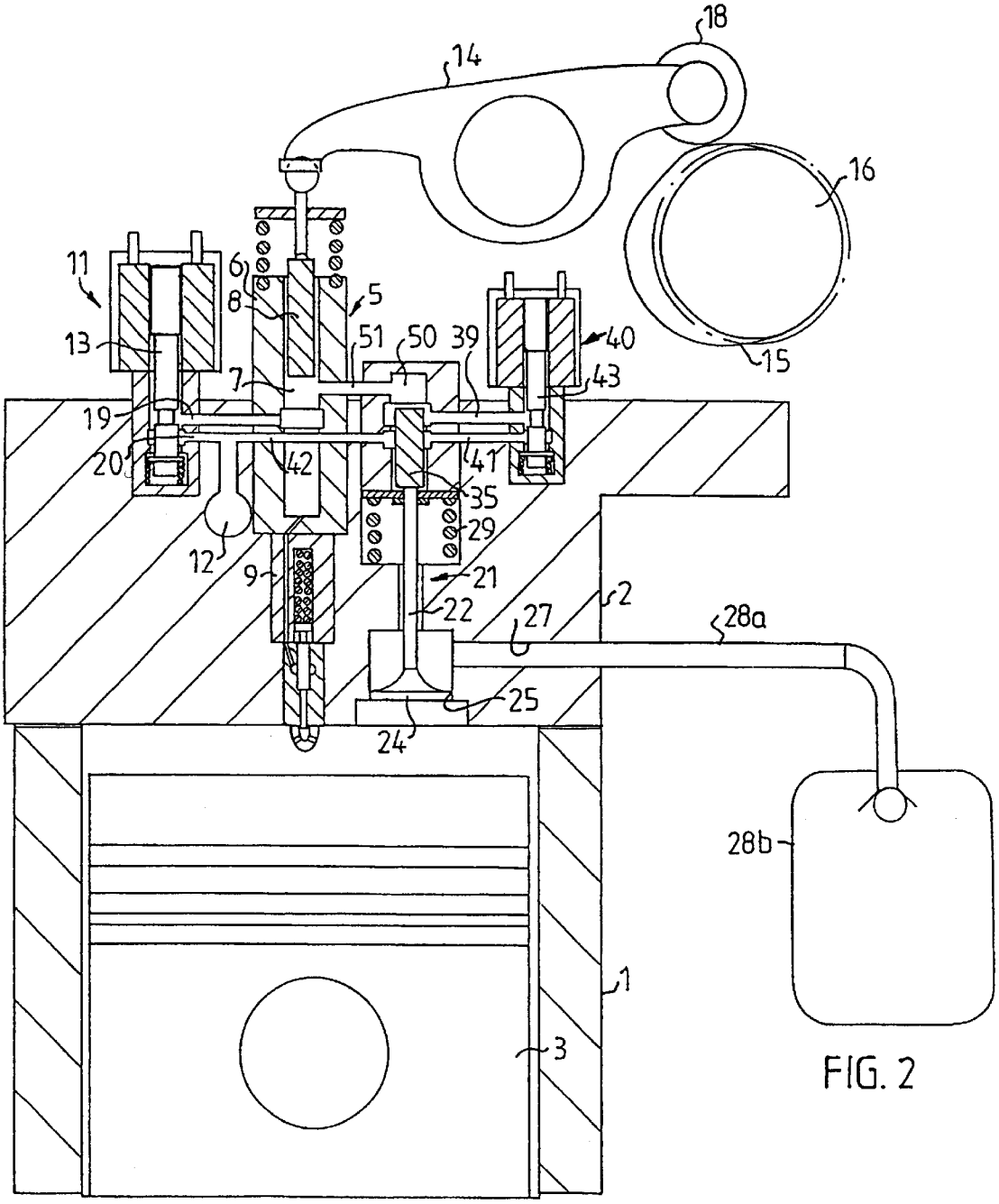
FIG. 2 shows a corresponding cross-section through a second embodiment of a portion of an engine according to the invention.

FIG. 2 shows a second embodiment of an engine according to the invention. Parts with direct counterparts in FIG. 1 have been given the same reference numerals as in FIG. 1, and only the structural and functional differences between the two embodiments will be described here.

In the embodiment in FIG. 2, there is no separate pump arrangement 32 for the exhaust valve 21. Instead, the operating plunger 35 of the exhaust valve 21 extends into a chamber 50 which communicates via a channel 51 with the pump chamber 7 of the unit injector pump portion 6, which is used here both to pump fuel and to open the exhaust valve 21. The opening and closing function is the same as described above. The difference lies in the structural simplification, i.e. the elimination of an extra pump and the integration of the two pump functions in the fuel pump 6. This requires the spill valve of the unit injector 5 to be involved in the control of the exhaust valve 21, since the spill valve also must be closed for high pressure to initially be generated in the pump chamber 7 and thus in the chamber 50 as well. The plunger areas are selected so that when the pressure at the beg g of the pump stroke reaches ca 150 bar (i.e. about half of the injector opening pressure of ca 300 bar), the exhaust valve 21 will open. The pump plunger 8 also has a valve function here by virtue of the fact that when it covers the outlet through the channel 51, it cuts off the connection between the pump chamber 7 and the chamber 50 of the operating plunger 35. The spill valve 11 can now be opened to prevent fuel injection without thereby reducing the pressure in the chamber 50. The subsequent closing of the east valve after a completed compression stroke is effected by merely opening the control valve 40 and connecting the chamber 50 to the low pressure side of the fuel system.

The invention provides, with simple and mostly already existing means, a previously unachieved speed and precision in opening and closing an extra exhaust valve during compressor operation of a diesel engine.

What is claimed is:

1. Internal combustion engine with compressor function, comprising inlet and exhaust valves for each engine cylinder, a fuel injection system with a unit injector and an electrically operated spill valve for each engine cylinder, a plurality of exhaust valves at at least one cylinder, one of said exhaust valves being a disc valve with a valve disc and a spindle disposed in a bore and cooperating with spring means, which bias the disc valve towards a closed position, and a hydraulic plunger cylinder device, by means of which the disc valve can be opened, characterized in that the plunger (35) of the plunger cylinder device (35,36) is subjected to the pressure in a pump chamber (7;33) which communicates with the fuel injection system and which belongs to pump means (7,8;33,34) which are driven by a cam element (15) having a cam curve (c), which initiates a pump stroke in said pump means before cam means (15) driving pump means (7,8) in the unit injector (5) initiate a pump stroke, and that the valve means comprise a control valve (40) which, in its closed position, blocks the communication of the pump chamber of the first mentioned pump means with the fuel injection system (12), so that the fuel volume enclosed during the pump stroke produces a displacement of the plunger (35) of the plunger cylinder device with associated displacement of the disc valve (21) towards its open position.

2. Internal combustion engine according to claim 1, characterized in that the cam element (15) also drives the pump means (7,8) of the unit injector (5) and has a cam curve (c,d), which first initiates a pump stroke in said first mentioned pump means (33,34) and then in the other pump means (7,8).

3. Internal combustion engine according to claim 2, characterized in that the cam element (15) cooperates with a cam follower (18) on a rocker arm (14), the rocking motion of which actuates both the pump stroke for injecting fuel and the pump stroke for opening the disc valve (21).

4. Internal combustion engine according to claim 1, characterized in that the spindle end of the disc valve (21) abuts against one end of the plunger (35) of the plunger cylinder device, the opposite end of said plunger being subjected to-the pressure in the pump chamber (7;33) in the first mentioned pump means.

5. Internal combustion engine according to claim 1, characterized in that said control valve is ;an electrically operated spill valve (40), which is controlled by a control unit, which also controls the spill valve of the unit injector.

6. Internal combustion engine according to claim 1, characterized in that said pump means is formed by two individual plunger pumps (7,8;33,34), one (7,8) of which is the fuel pump integrated in the unit injector.

7. Internal combustion engine according to claim 1, characterized in that both of said pump means are formed by the fuel pump (7,8) integrated in the unit injector, the pump chamber (7) of said fuel pump communicating with a chamber (50), into which the plunger (35) protrudes.

8. Internal combustion engine according to claim 7, characterized in that the pump chamber (7) of the fuel pump (7,8) communicates with the chamber (50) into which the plunger (35) protrudes, via a communication (51), which is shut off by the pump plunger (8) of the fuel pump after a predetermined initial pump stroke.

9. Internal combustion engine according to claim 3, characterized in that the spindle end of the disc valve (21) abuts against one end of the plunger (35) of the plunger cylinder device, the opposite end of said plunger being subjected to the pressure in the pump chamber (7;33) in the first mentioned pump means.

10. Internal combustion engine according to claim 9, characterized in that said control valve is an electrically operated spill valve (40), which is controlled by a control unit, which also controls the spill valve of the unit injector.

11. International combustion engine according to claim 10, characterized in that said pump means is formed by two individual plunger pumps (7, 8; 33, 34), one (7, 8) of which is the fuel pump integrated in the unit injector.

12. Internal combustion engine according to claim 10, characterized in that both of said pump means are formed by the fuel pump (7, 8) integrated in the unit injector, the pump chamber (7) of said fuel pump communicating with a chamber (50), into which the plunger (35) protrudes.

* * * * *